US011208713B2

(12) United States Patent
Wang

(10) Patent No.: US 11,208,713 B2
(45) Date of Patent: Dec. 28, 2021

(54) HIGHLY ELECTRICALLY CONDUCTIVE SURFACES FOR ELECTROCHEMICAL APPLICATIONS

(71) Applicant: TREADSTONE TECHNOLOGIES, INC., Princeton, NJ (US)

(72) Inventor: Conghua Wang, West Windsor, NJ (US)

(73) Assignee: TREADSTONE TECHONOLOGIES, INC., Princeton, NJ (US)

( * ) Notice: Subject to any disclaimer, the term of this patent is extended or adjusted under 35 U.S.C. 154(b) by 126 days.

(21) Appl. No.: 15/688,423

(22) Filed: Aug. 28, 2017

(65) Prior Publication Data

US 2017/0356074 A1 Dec. 14, 2017

Related U.S. Application Data

(62) Division of application No. 12/350,896, filed on Jan. 8, 2009, now Pat. No. 9,765,421.

(Continued)

(51) Int. Cl.
*C23C 4/04* (2006.01)
*C23C 4/08* (2016.01)

(Continued)

(52) U.S. Cl.
CPC ..... *C23C 4/08* (2013.01); *C23C 4/01* (2016.01); *C23C 4/06* (2013.01); *C23C 4/10* (2013.01);

(Continued)

(58) Field of Classification Search
CPC .... C23C 4/08; C23C 4/01; C23C 4/06; C23C 4/10; C23C 4/18; Y10T 428/31678; Y10T 428/24612; Y10T 428/1239
See application file for complete search history.

(56) References Cited

U.S. PATENT DOCUMENTS 3,755,105 A 8/1973 Messner
4,031,268 A 6/1977 Fairbairn (Continued)

FOREIGN PATENT DOCUMENTS

CH 533 691 2/1973
CN 101918619 12/2010

(Continued)

OTHER PUBLICATIONS

A.S. Woodman et al., "Development of Corrosion-Resistant Coatings for Fuel Cell Bipolar Plates", American Electroplaters and Surface Finishers Society, AESF SUR/FIN '99 Prooceedings, Jun. 21-24, 1999.

(Continued)

*Primary Examiner* — Jonathan C Langman
(74) *Attorney, Agent, or Firm* — DLA Piper LLP (US)

(57) ABSTRACT

A method is described that can be used in electrodes for electrochemical devices and includes disposing a precious metal on a top surface of a corrosion-resistant metal substrate. The precious metal can be thermally sprayed onto the surface of the corrosion-resistant metal substrate to produce multiple metal splats. The thermal spraying can be based on a salt solution or on a metal particle suspension. A separate bonding process can be used after the metal splats are deposited to enhance the adhesion of the metal splats to the corrosion-resistant metal substrate. The surface area associated with the splats of the precious metal is less than the surface area associated with the top surface of the corrosion-resistant metal substrate. The thermal spraying rate can be controlled to achieve a desired ratio of the surface area of the metal splats to the surface area of the corrosion-resistant metal substrate.

9 Claims, 13 Drawing Sheets

Related U.S. Application Data

(60) Provisional application No. 61/019,657, filed on Jan. 8, 2008, provisional application No. 61/023,273, filed on Jan. 24, 2008, provisional application No. 61/089,233, filed on Aug. 15, 2008.

(51) Int. Cl.

| | |
|---|---|
| ***C23C 4/06*** | (2016.01) |
| ***C23C 4/10*** | (2016.01) |
| ***C23C 4/18*** | (2006.01) |
| ***C23C 4/01*** | (2016.01) |

(52) U.S. Cl.

CPC ..... *C23C 4/18* (2013.01); *Y10T 428/12396* (2015.01); *Y10T 428/24612* (2015.01); *Y10T 428/31678* (2015.04)

(56) References Cited

U.S. PATENT DOCUMENTS

| | | | | |
|---|---|---|---|---|
| 4,104,785 | A | 8/1978 | Shiba | |
| 4,310,404 | A | 1/1982 | Satoh | |
| 4,643,818 | A | 2/1987 | Seko et al. | |
| 4,666,743 | A | 5/1987 | Ohta et al. | |
| 4,706,870 | A | 11/1987 | Legge | |
| 5,098,485 | A | 3/1992 | Evans | |
| 5,290,410 | A | 3/1994 | Tenfalt et al. | |
| 5,397,657 | A | 3/1995 | Ito et al. | |
| 5,624,769 | A | 4/1997 | Li et al. | |
| 5,682,067 | A | 10/1997 | Manley et al. | |
| 6,071,570 | A | 6/2000 | Hardee et al. | |
| 6,149,794 | A | 11/2000 | Heimann et al. | |
| 6,153,080 | A | 11/2000 | Heimann et al. | |
| 6,245,390 | B1 | 6/2001 | Baranovski et al. | |
| 6,258,243 | B1 | 7/2001 | Heimann et al. | |
| 6,322,687 | B1 | 11/2001 | Heimann et al. | |
| 6,372,376 | B1 | 4/2002 | Fronk et al. | |
| 6,379,476 | B1 | 4/2002 | Tarutani et al. | |
| 6,425,745 | B1 | 7/2002 | Lavin | |
| 6,455,108 | B1 | 9/2002 | Muffoletto et al. | |
| 6,475,958 | B1 | 11/2002 | Paul | |
| 6,572,756 | B2 | 6/2003 | Heimann et al. | |
| 6,592,738 | B2 | 7/2003 | Heimann et al. | |
| 6,599,643 | B2 | 7/2003 | Heimann et al. | |
| 6,649,031 | B1 | 11/2003 | Iqbal et al. | |
| 6,685,988 | B2 * | 2/2004 | Van Steenkiste ..... | H01R 4/58 427/123 |
| 6,728,092 | B2 | 4/2004 | Hunt et al. | |
| 6,761,990 | B1 | 7/2004 | Yoshitake | |
| 6,919,543 | B2 | 7/2005 | Abbott | |
| 6,924,002 | B2 | 8/2005 | Lee et al. | |
| 6,994,779 | B2 | 2/2006 | Heimann et al. | |
| 7,052,741 | B2 | 5/2006 | Medeiros et al. | |
| 7,070,833 | B2 | 7/2006 | Smith et al. | |
| 7,144,628 | B2 | 12/2006 | Kudo et al. | |
| 7,144,648 | B2 | 12/2006 | Tawfik et al. | |
| 7,309,540 | B2 | 12/2007 | Wang | |
| 7,399,532 | B2 | 7/2008 | Seido et al. | |
| 7,758,921 | B2 | 7/2010 | Liu et al. | |
| 7,763,152 | B2 | 7/2010 | Suzuki et al. | |
| 7,846,591 | B2 | 12/2010 | Gu et al. | |
| 2001/0050231 | A1 | 12/2001 | Heimann et al. | |
| 2002/0012804 | A1 | 1/2002 | Heimann et al. | |
| 2002/0054998 | A1 | 5/2002 | Heimann et al. | |
| 2002/0151161 | A1 | 10/2002 | Furusawa | |
| 2002/0168466 | A1 | 11/2002 | Tapphorn et al. | |
| 2003/0124427 | A1 | 7/2003 | Takeuchi et al. | |
| 2003/0178317 | A1 | 9/2003 | Heimann et al. | |
| 2003/0235711 | A1 | 12/2003 | Seido et al. | |
| 2004/0081881 | A1 | 4/2004 | Vyas et al. | |
| 2004/0086689 | A1 | 5/2004 | Takahashi | |
| 2004/0197661 | A1 * | 10/2004 | Utsunomiya ..... | C23C 30/00 429/247 |
| 2005/0026020 | A1 | 2/2005 | Franklin | |
| 2005/0089742 | A1 | 4/2005 | Ishigami et al. | |
| 2005/0100771 | A1 | 5/2005 | Vyas et al. | |
| 2005/0158621 | A1 * | 7/2005 | Benoit ..... | H01M 6/5066 429/178 |
| 2005/0260473 | A1 | 11/2005 | Wang | |
| 2005/0266161 | A1 | 12/2005 | Medeiros et al. | |
| 2006/0003174 | A1 | 1/2006 | Yashiki et al. | |
| 2006/0011490 | A1 | 1/2006 | Nguyen et al. | |
| 2006/0019142 | A1 | 1/2006 | Abd Elhamid et al. | |
| 2006/0094309 | A1 | 5/2006 | Holtkamp et al. | |
| 2006/0141340 | A1 | 6/2006 | Takeuchi et al. | |
| 2006/0222777 | A1 | 10/2006 | Skoog et al. | |
| 2007/0015034 | A1 | 1/2007 | Vyas et al. | |
| 2007/0138147 | A1 | 6/2007 | Molz et al. | |
| 2007/0160899 | A1 | 7/2007 | Atanassova et al. | |
| 2007/0231673 | A1 | 10/2007 | Noh | |
| 2007/0248832 | A1 | 10/2007 | Maeda et al. | |
| 2008/0085439 | A1 | 4/2008 | Hilliard | |
| 2008/0134493 | A1 | 6/2008 | Vyas et al. | |
| 2008/0145633 | A1 | 6/2008 | Kodas et al. | |
| 2008/0220234 | A1 | 9/2008 | Ko et al. | |
| 2009/0042084 | A1 * | 2/2009 | Kobayashi ..... | C23C 18/42 429/484 |
| 2009/0087549 | A1 * | 4/2009 | Zhou ..... | H01M 4/8817 427/115 |
| 2009/0176120 | A1 | 7/2009 | Wang | |
| 2010/0021634 | A1 | 1/2010 | Kodas et al. | |
| 2010/0133111 | A1 | 6/2010 | Nocera et al. | |
| 2010/0151267 | A1 | 6/2010 | Kodas et al. | |
| 2010/0143781 | A1 | 7/2010 | Keshavarz et al. | |
| 2010/0285386 | A1 | 11/2010 | Wang | |
| 2011/0076587 | A1 | 3/2011 | Wang et al. | |
| 2011/0091789 | A1 | 4/2011 | Mofakhami et al. | |
| 2012/0145532 | A1 | 6/2012 | Smolyakov et al. | |
| 2014/0242462 | A1 | 8/2014 | Wang | |

FOREIGN PATENT DOCUMENTS

| | | |
|---|---|---|
| CN | 102074715 B | 7/2015 |
| EP | 1 369 504 | 12/2003 |
| EP | 1 808 920 | 7/2007 |
| EP | 1 847 628 | 10/2007 |
| JP | 1-301878 | 12/1989 |
| JP | 2003-268567 | 9/2003 |
| JP | 2006-080083 | 3/2006 |
| KR | 10-2006-0106865 | 10/2006 |
| WO | WO 02/059936 | 8/2002 |
| WO | WO 2004/052559 | 6/2004 |
| WO | WO 2005/085490 | 9/2005 |
| WO | WO 2007/149881 | 12/2007 |
| WO | WO 2014/134019 | 9/2014 |

OTHER PUBLICATIONS

Toshiki SATO et al., "The Titanium Separator with Stable Durability and Low Electrical Resistance", Materials Research Laboratory, Kobelco Kobe Steel Group, 10 pages, Undated.

D.S.R. Krishna et al., "Effect of Thermal Oxidation Conditions on Tribological Behaviour of Titanium Films on 316L Stainless Steel", Science Direct Surface & Coating Technology, vol. 198, pp. 447-453 (2005).

J. Berghaus et al., "Suspension Plasma Spraying of Nanostructured WC-12Co Coatings", Journal of Thermal Spray Technology, vol. 15(4), pp. 676-681, Dec. 2006.

International Search Report issued in International Application No. PCT/US2009/030475, dated Aug. 19, 2009.

Written Opinion issued in International Application No. PCT/US2009/030475, dated Aug. 19, 2009.

International Preliminary Report on Patentability issued in International Application No. PCT/US2009/030475, dated Jul. 22, 2010.

Erich Lugscheider et al., "Reactive Plasma Spraying of Titanium", Advanced Engineering Materials, vol. 2, No. 5, pp. 281-284 (2000).

Supplementary European Search Report issued in EP 09 70 0943, dated Jan. 25, 2011.

International Search Report issued in International Application No. PCT/US2010/050578, dated Jun. 7, 2011.

(56) References Cited

OTHER PUBLICATIONS

Written Opinion issued in International Application No. PCT/US2010/050578, dated Jun. 7, 2011.
English language abstract of KR 10-2006-0106865, published Oct. 12, 2006.
English language abstract of CH 533,691, published Feb. 15, 1973.
Machine English language translation of CH 533,691, published Feb. 15, 1973.
"Thermal Spraying: Practice, Theory, and Application", American Welding Society, pp. 3, 31, and 32 (1985).
Tzeng, et al. "Electrical Contacting Techniques for High TC Superconductor Applications", Superconductivity and Its Applications, 1998, pp. 174-179.
Chinese Office Action issued in CN 200980101881 dated Jun. 5, 2012.
Partial English language translation of Chinese Office Action issued in CN 200980101881 dated Jun. 5, 2012.
European Office Action issued in EP 09700943.5, dated Jun. 27, 2012.
Yamada, et al. "Nitridation of aluminum particles and formation process of aluminum nitride coatings by reactive RF plasma spraying," Thin Solid Films 515 (2007), pp. 4166-4171.
Bacci et al. "Reactive plasma spraying of titanium in nitrogen containing plasma gas", Materials Science and Engineering A283 (2000), pp. 189-195.
Chinese Office Action issued in CN 200980101881 dated Jan. 6, 2013.
Partial English language translation of Chinese Office Action issued in CN 200980101881 dated Jan. 6, 2013.
"Laser Plating and Melting for Hard metal Surfaces", IBM Technical Disclosure Bulletin, vol. 26, No. 7A, Dec. 1, 1983.
Chinese Office Action issued in CN 200980101881 dated Aug. 1, 2014.
Partial English language translation of Chinese Office Action issued in CN 200980101881 dated Aug. 1, 2014.
Korean Office Action issued in Korean Application No. 10-2010-7017499 dated Jan. 20, 2015.
English language translation of Korean Office Action issued in Korean Application No. 10-2010-7017499 dated Jan. 20, 2015.
English language abstract and translation of JP 2003-268567 published Sep. 25, 2003.
International Search Report issued in International Application No. PCT/US2014/033667 dated Oct. 8, 2014.
Written Opinion issued in International Application No. PCT/US2014/033667 dated Oct. 8, 2014.
P. Gougeon et al., "Simultaneous Independent Measurement of Splat Diameter and Cooling Time during Impact on a Substrate of Plasma-Sprayed Molybdenum Particles", Journal of Thermal Spray Technology, vol. 10, No. 1, pp. 76-82, Mar. 2001.
J.W. Luster et al., "Formation and Characterization of Corrosion Resistant Amorphous Coating by Thermal Spraying", In Surface Modification Technologies IX, pp. 479-493 (1996).
International Search Report issued in International Application No. PCT/US2014/018260 dated May 30, 2014.
Written Opinion issued in International Application No. PCT/US2014/018260 dated May 30, 2014.
L.C. Erickson et al., "Alumina Coatings by Plasma Spraying of Monosize Sapphire Particles", Journal of Thermal Spray Technology, vol. 8, No. 3, pp. 421-426. Sep. 1999.
Supplementary European Search Report issued in EP 14 75 6924 dated Jun. 29, 2016.
Machine English language abstract and translation of CN102074715 published Jul. 22, 2015.
Machine English language abstract and translation of JP2006080083 published Mar. 23, 2006.
Supplementary European Search Report issued in EP 14 78 3237 dated Jun. 16, 2016.
Chinese Office Action issued in CN 201480008566.7 dated Jun. 2, 2017.
English language translation of Chinese Office Action issued in Chinese Application No. 201480008566.7 dated Jun. 2, 2017.
Partial English language translation CN 101918619 dated Dec. 15, 2010.
U.S. Appl. No. 12/350,896.
U.S. Appl. No. 12/892,791.
U.S. Appl. No. 13/931,393.
U.S. Appl. No. 14/189,223.
Korean Office Action issued in Korean Application No. 10-2010-7017499 dated Oct. 6, 2020.
Canada Office Action issued in Application No. 2,899,513 dated Nov. 10, 2020.

* cited by examiner

HIGHLY ELECTRICALLY CONDUCTIVE SURFACES FOR ELECTROCHEMICAL APPLICATIONS

The present application is a Divisional of U.S. application Ser. No. 12/350,896, filed Jan. 8, 2009 which claims priority to U.S. Provisional Application Ser. No. 61/089,233, filed on Aug. 15, 2008, entitled "Method to Produce High Electrical Conductive Surface for Electrochemical Applications," U.S. Provisional Application Ser. No. 61/023,273, filed on Jan. 24, 2008, entitled "Spray Method for the Formation of High Electrical Conductive Surface for Electrochemical Applications," and U.S. Provisional Application Ser. No. 61/019,657, filed on Jan. 8, 2008, entitled "Method of Metal Corrosion Protection for Electrochemical Applications," each of which is incorporated herein by reference in its entirety.

FIELD

The present invention relates to methods for improving the metal surface conductivity and/or the corrosion resistance of metal components used in electrochemical applications, and more particularly, to the design of such metal components and the use of cost-effective processing methods for depositing small amounts of conductive materials to reduce the surface electrical contact resistance of a corrosion-resistant metal substrate surface.

BACKGROUND

Metallic materials are widely used in various devices for electrochemical applications, including electrodes used in a chlor-alkali processes and separate/interconnect plates used in both low temperature (proton exchange membrane) and high temperature (solid oxide) fuel cells. Metal-based components are also used in batteries, electrolyzers, and electrochemical gas separation devices, for example. In these and similar applications, it is desirable for the metal-based components to have a surface with high electrical conductance (or low electrical resistance) to reduce the internal electrical losses that can occur in the electrochemical devices and achieve high operation efficiency in such devices. One of the difficulties usually encountered in electrochemical applications is that the metal-based component need also have high corrosion-resistant properties in addition to having high electrical conductance.

Coating metal-based components with a corrosion-resistant material, such as a chromium or nickel layer, for example, is a common industrial practice. These materials, however, cannot be used in some types of severe corrosive environments in electrochemical devices. While precious metals have excellent corrosion-resistant properties and are also highly conductive, they tend to be too costly for large-volume commercial applications.

Other materials, such as titanium, zirconium, and silicon, for example, can have outstanding corrosion-resistant properties, particularly after applying proper passivation treatments. These materials, however, have other limitations. For example, the electrical contact resistance of these materials is very high, especially after passivation. Moreover, these materials are too costly and/or are sometimes difficult to process. As a result, these materials can be limited in their commercial use.

Therefore, there is a need for technologies that can provide reduced-cost coatings for use in electrochemical applications that improve the electrical conductivity and/or corrosion-resistant of those substrates. Such coatings can be used in devices for electrochemical applications having metal-based components, such as fuel cells, batteries, electrolyzers, and gas separation devices, for example.

DETAILED DESCRIPTION

Various embodiments are described below for methods in which materials can be disposed on metal substrates for use in electrochemical applications that improve the electrical conductivity and/or corrosion-resistant of those substrates at reduced or lower costs. Such embodiments can be used in devices for electrochemical applications having metal-based components, such as fuel cells, batteries, electrolyzers, and gas separation devices, for example.

In some embodiments, the electrical contact resistance of a corrosion-resistant metal substrate can be reduced by depositing multiple highly-electrically-conductive contact points or contact areas on the corrosion-resistant metal substrate surface. These contact points can be used to electrically connect the component having the corrosion-resistant metal substrate with other components in electrochemical devices to maintain good electrical continuity. These contact points need not cover the entire surface (e.g., contacting surface) of the corrosion-resistant metal substrate, resulting in lower materials and processing costs. These contact points can include various corrosion-resistant and/or electrically-conductive materials, such as, but not limited to, precious metals, conductive nitrides, carbides, borides and carbon, for example.

Figure 1A:
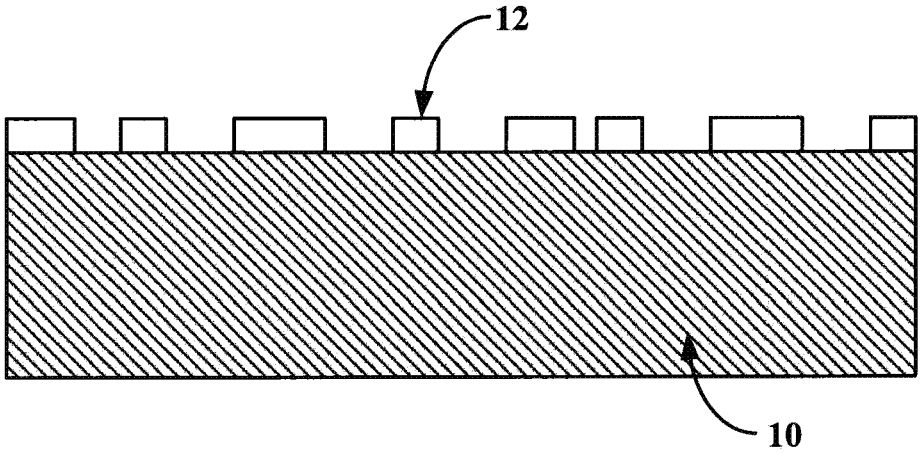
FIG. 1A is a schematic cross-sectional view of a structure including multiple splats deposited on the surface of a corrosion-resistant metal substrate, according to an embodiment.

FIG. 1A is a schematic cross-sectional view of a structure including multiple metal splats or dots 12 deposited on a surface of a corrosion-resistant metal substrate 10, according to an embodiment. The metal splats 12 can be used as highly-electrically-conductive contact points for contacting metal components in, for example, an electrochemical device. In one example, the corrosion-resistant metal substrate 10 can include titanium, niobium, zirconium, and/or tantalum, and/or an alloy made of any one of such materials. In another example, the corrosion-resistant metal substrate 10 can include low-cost carbon steel, stainless steel, copper, and/or aluminum, and/or an alloy made of any one of such materials. In yet another example, the corrosion-resistant metal substrate 10 can include iron, chromium, or nickel, or an alloy made of any one of such materials. In some embodiments, the corrosion-resistant metal substrate 10 can include a corrosion-resistant coating layer disposed on a surface of a metal substrate and having better corrosion resistive properties than the metal substrate. The corrosion-resistant coating layer can be disposed on the metal substrate by using a vapor deposition process (e.g., PVD or CVD). To improve the adhesion of the corrosion-resistant coating layer with the metal substrate, a bonding process can be applied. For example, the corrosion-resistant layer can be thermally treated at 450° C. in air for approximately one hour. The use of a corrosion-resistant coating layer to further improve the corrosion resistance of the metal substrate is further described below with respect to FIG. 8.

The metal splats 12 can include precious metal particles that are sprayed and/or bonded onto the surface of the corrosion-resistant metal substrate 10. The metal splats 12 can have high electrical conductivity and can include gold, palladium, platinum, iridium, and/or ruthenium. In one example, a material used for the metal splats 12 can have a contact resistance of about 50 milliohms-per-square centimeter ($m\Omega/cm^2$) or lower. In some embodiments, it may be desirable for the contact resistance of the material used for the metal splats 12 to have a contact resistance of 10 $m\Omega/cm^2$ or lower, for example. A thickness associated with the metal splats 12 is in the range of about 1 nanometer (nm) to about 5 microns (μm). In some embodiments, metal splats 12 is gold, and the thickness of the splats can have a range of 1 nm-5 nm, 1 nm-10 nm, 10 nm-50 nm, 10 nm-100 nm, 10 nm-20 μm, 1 nm-0.5 μm, 20 nm-0.5 μm, 100 nm-0.5 μm, 20 nm-1 μm, 100 nm-1 μm, 0.5 μm-5 μm, or 1 μm-20 μm, for example, with a range of 10 nm-20 μm being desirable in certain embodiments. The electrically-conductive metal splats 12 can be deposited on the corrosion-resistant metal substrate 10 through a thermal or a cold spray process, for example.

Thermal spraying techniques provide a low-cost, rapid fabrication deposition technique that can be used to deposit a wide range of materials in various applications. In a typical thermal spraying, materials are first heated to, for example, temperatures higher than 800 degrees Celsius (° C.), and subsequently sprayed onto a substrate. The material can be heated by using, for example, a flame, a plasma, or and electrical arc and, once heated, the material can be sprayed by using high flow gases. Thermal spraying can be used to deposit metals, ceramics, and polymers, for example. The feeding materials can be powders, wires, rods, solutions, or small particle suspensions.

There are various types of thermal spraying techniques that can be used for material deposition, such as those using salt solutions, metal particle suspensions, dry metal particles, metal wires, or composite particles having a metal and a ceramic. One type of thermal spraying is cold gas dynamic spraying. In cold gas dynamic spraying, the material is deposited by sending the materials to the substrate at very high velocities, but with limited heat, typically at temperatures below 1000 degrees Fahrenheit (° F.). This process, however, has the advantage of the properties of the material that is being deposited are less likely to be affected by the spraying process because of the relatively low temperatures.

In this embodiment, the metal splats 12 can be thermally sprayed onto the top surface of the corrosion-resistant metal substrate 10 by thermally spraying a salt solution or a metal particle suspension. The salt solution can include a one percent (1%) in weight gold acetate solution in water, for example. The metal particle suspension can include gold powder, ethylene glycol, and a surfactant, for example. In one example, the metal particle suspension can include a mix having 2.25 grams (g) of gold powder (at about 0.5 μm in diameter), 80 g of ethylene glycol, and 0.07 g of surfactant (PD-700 from Uniquema) and then dispersed for 15 minutes using an ultrasonic probe.

The metal splats 12 can be deposited to cover a portion of the surface (e.g., the top surface area) of the corrosion-resistant metal substrate 10 that is less than the entire surface of the corrosion-resistant metal substrate 10. Said differently, less than the entire area of the surface of the corrosion-resistant metal substrate 10 that is typically used for contacting other components is covered by the metal splats 12. In this manner, the metal splats 12 can increase the electrical conductance of the surface of the corrosion-resistant metal substrate 10 but the amount of precious metal that is used can be significantly less than if a continuous metal layer was deposited on the corrosion-resistant metal substrate 10. In some embodiments, the portion or amount (e.g., top surface area) of the corrosion-resistant metal substrate 10 that is covered by the multiple metal splats 12 can be predetermined and the rate at which the metal splats 12 are disposed can be controlled to achieve that predetermined amount. For example, the percentage of the surface of the corrosion-resistant metal substrate 10 covered by the metal splats 12 can be in the range of 0.5 percent (%) to 10%, 10% to 30%, 20% to 40%, 30% to 50%, 40% to 60%, or 50% to 70%, or 50% to 95%. In some embodiments, the percentage of the surface of the corrosion-resistant metal substrate 10 covered by the metal splats 12 can be approximately 50% or less, 60% or less, 70% or less, or 95% or less.

In some embodiments, other deposition methods can be used to deposit the metal splats or dots 12 on the corrosion-resistant metal substrate 10. One of the most common deposition techniques is the use of a plating process to plate precious metal on a substrate. In some instances, plating can result in poor adhesion of the plated metal dots or particles 12 on the corrosion-resistant metal substrate 10. In such instances, a subsequent bonding step or process may be desirable to improve the adhesion characteristics. A bonding step or process can include thermally treating the metal splats 12 at 450 degrees Celsius (° C.) in air for approximately one hour, for example. Another deposition technique is physical vapor deposition (PVD) in which materials are deposited on the substrate in vacuum. PVD, however, is very expensive because of the cost associated with generating a vacuum.

Figure 1B:
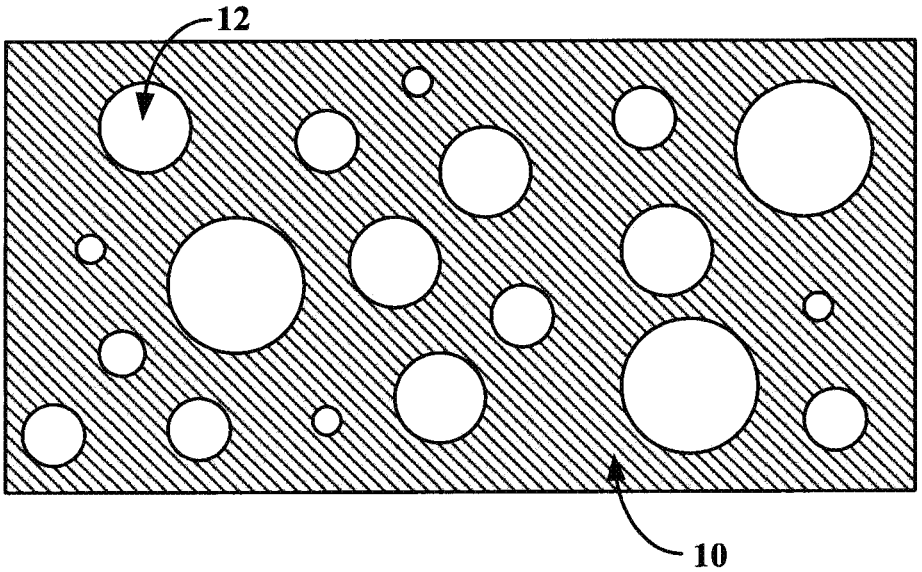
FIG. 1B is a schematic plan view of the structure described in FIG. 1A.

FIG. 1B is a schematic plan view of the structure described in FIG. 1A. As shown in FIG. 1B, as a result of the spraying process, the size and/or location of each of the metal splats 12 varies over the top surface of the corrosion-resistant metal substrate 10. For example, the metal splats 12 need not have a particular pattern or spatial distribution.

Figure 2A:
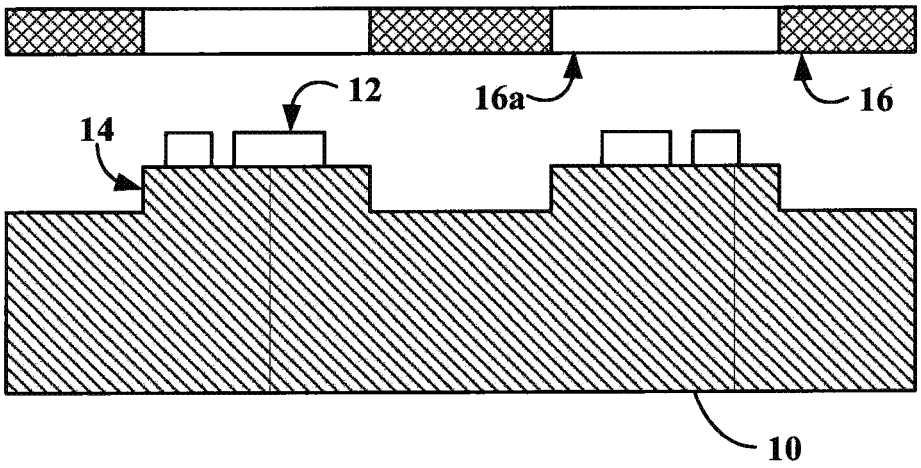
FIG. 2A is a schematic cross-sectional view of a structure including multiple splats deposited on raised portions of the surface of a corrosion-resistant metal substrate, according to an embodiment.

FIG. 2A is a schematic cross-sectional view of a structure including multiple metal splats 12 deposited on raised portions 14 of the surface of a corrosion-resistant metal substrate 10, according to an embodiment. In some instances, the corrosion-resistant metal substrate 10 can have raised portions 14 for making physical and electrical contact with another device or component while the lower portion (valley) can be used for the mass transport during a reaction (e.g., an electrochemical reaction). In those instances, it may be desirable for the metal splats 12 to be deposited in the raised portions 14 of the corrosion-resistant metal substrate 10 and not in the other portions of the corrosion-resistant metal substrate 10. In this manner, the use of the precious metal in the metal plats 12 is limited to those regions that are intended for physical and electrical contact.

To contain or limit the deposition of the metal splats 12 to the raised portions 14 of the corrosion-resistant metal substrate 10, a mask 16 having openings 16*a* can be used. For example, during thermal spraying, the openings 16*a* can be configured to substantially coincide with the raised portions 14 such that metal splats 12 are deposited on the raised portions 14 and not on other portions or regions of the corrosion-resistant metal substrate 10. The mask can be temporary and can be removed after the processing, or can be permanent and can remain with the metal plate.

Figure 2B:
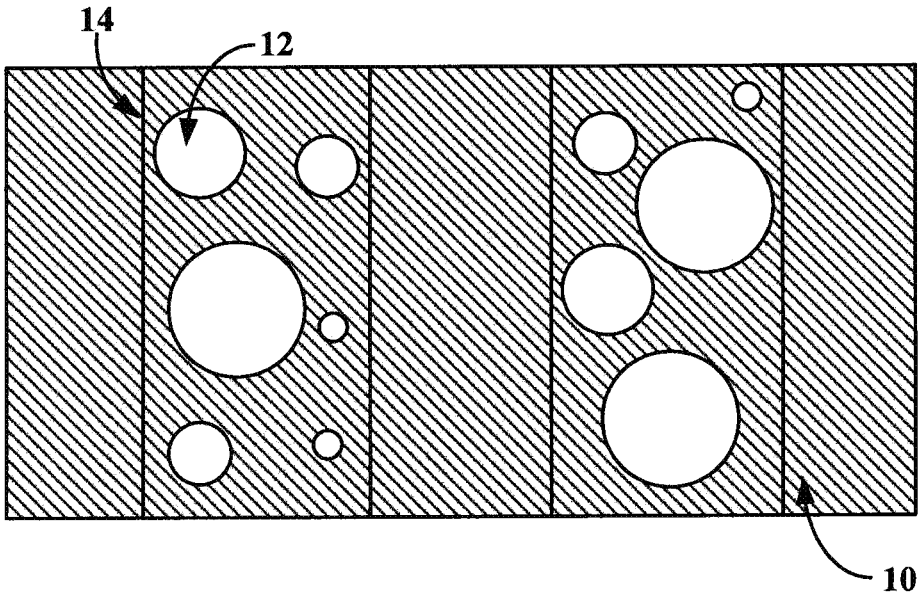
FIG. 2B is a schematic plan view of the structure described in FIG. 2A.

FIG. 2B is a schematic plan view of the structure described in FIG. 2A. As shown in FIG. 2B, as a result of the masked spraying process, the location of each of the metal splats 12 is limited to the raised regions 14 of the corrosion-resistant metal substrate 10.

Figure 3:
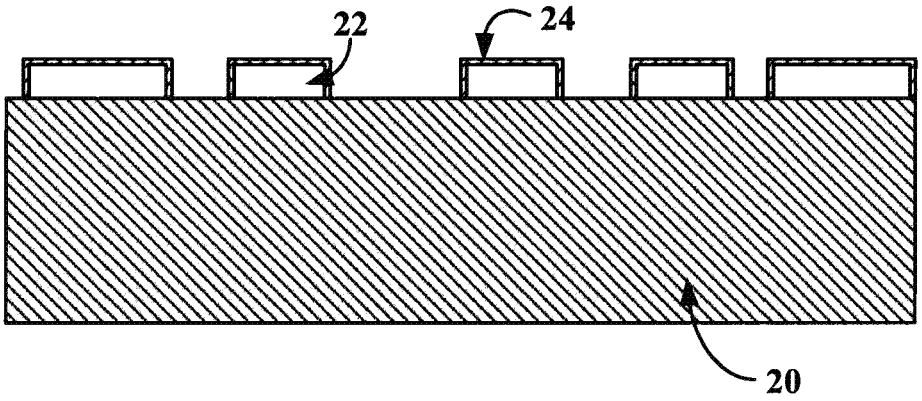
FIG. 3 is a schematic cross-sectional view of a structure including multiple corrosion-resistant particles having a precious metal layer and deposited on the surface of a corrosion-resistant metal substrate, according to an embodiment.

FIG. 3 is a schematic cross-sectional view of a structure including multiple corrosion-resistant particles 22 having a conductive metal layer 24 deposited on a surface of a corrosion-resistant metal substrate 20, according to an embodiment. The metal layer 24 can be used as highly-electrically-conductive contact points for contacting metal components in, for example, an electrochemical device. In one example, the corrosion-resistant metal substrate 20 can include titanium, niobium, zirconium, and/or tantalum, and/or an alloy made of any one of such materials. In another example, the corrosion-resistant metal substrate 20 can include low-cost carbon steel, stainless steel, copper, and/or aluminum, and/or an alloy made of any one of such materials. In yet another example, the corrosion-resistant metal substrate 20 can include iron, chromium, or nickel, or an alloy made of any one of such materials. The corrosion-resistant particles 22 can be made of an initial material that can be used as a precursor for the conductive metal layer 24.

The corrosion-resistant metal or alloy particles 22 can be deposited and/or bonded on the top surface of the corrosion-resistant metal substrate 20. The corrosion-resistant particles 22 can be disposed on the top surface of the corrosion-resistant metal substrate 20 through a thermal spraying process, a selective plating process, a selective etching process, or a sputtering process using shield masks, for example. The corrosion-resistant particles 22 can be deposited as splats, dots, and/or strips, in accordance with the deposition technique used. The bonding can include a thermal treatment of corrosion-resistant particles 22 at 450° C. in air for approximately one hour, for example. The corrosion-resistant particles 22 can include palladium, for example. A thickness associated with the corrosion-resistant particles 22 is in the range of about 0.01 μm to about 20 μm. In some embodiments, the thickness of the corrosion-resistant particles 22 can have a range of 0.01 μm-0.2 μm, 0.1 μm-0.5 μm, 0.1 μm-1 μm, 0.1 μm-5 μm 0.5 μm-1 μm, 1 μm-2 μm, 1 μm-5 μm, 2 μm-5 μm, 5 μm-10 μm, or 10 μm-20 μm for example, with a range of 0.1 μm-5 μm being desirable in certain embodiments.

The thin electrically-conductive metal layer 24 can include a precious metal and can be selectively plated (e.g., by electro-chemical plating process or by an electroless chemical plating process) on the outer surface of the corrosion-resistant particles 22. The conductive metal layer 24 that covers the corrosion-resistant particles 22 is used to improve the electrical conductance and/or the corrosion resistance of the corrosion-resistant particles 22. The conductive metal layer 24 can include gold, platinum, iridium, and ruthenium, for example. A thickness associated with the conductive metal layer 24 is in the range of about 1 nm to about 1 μm. In some embodiments, the thickness of the conductive metal layer 24 can have a range of 1 nm-5 nm, 1 nm-10 nm, 10 nm-50 nm, 10 nm-100 nm, 1 nm-0.5 μm, 20 nm-0.5 μm, 100 nm-0.5 μm, or 100 nm-1 μm, for example, with a range of 10 nm-100 nm being desirable in certain embodiments.

The corrosion-resistant particles 22 can be deposited to cover a portion of the top surface of the corrosion-resistant metal substrate 20 that is less than the entire surface of the corrosion-resistant metal substrate 20. In this manner, the corrosion-resistant particles 22 with the conductive metal layer 24 can be used as highly-electrically-conductive contact points to increase the electrical conductance of the surface of the corrosion-resistant metal substrate 20 but at a lower cost than if a continuous metal layer was deposited on the corrosion-resistant metal substrate 20. Similar ratios or percentages as described above in FIG. 1A with respect to the portion of the top surface area of the corrosion-resistant metal substrate 10 covered by the metal splats 12 are also applicable to the coverage provided by the corrosion-resistant particles 22 in FIG. 3.

As shown in FIG. 3, the corrosion-resistant particles 22 are disposed on the top surface of the corrosion-resistant metal substrate 20, and preferably, in regions or portions of the top surface of the corrosion-resistant metal substrate 20 that are to be used for physically and electrically contacting other components such that the electrical contact resistance in those regions is reduced by the corrosion-resistant particles 22 with the conductive metal layer 24. One example of an application for the structured described with respect to FIG. 3 is in a polymer electrolyte member (PEM) fuel cell in which the metal bipolar plate is in direct contact with the graphite gas diffusion layer (GDL). In this example, the corrosion-resistant particles 22 (e.g., gold-covered palladium splats) can be in direct contact with GDL to achieve low electrical contact resistance between the metal bipolar plate and the GDL.

Figure 4:
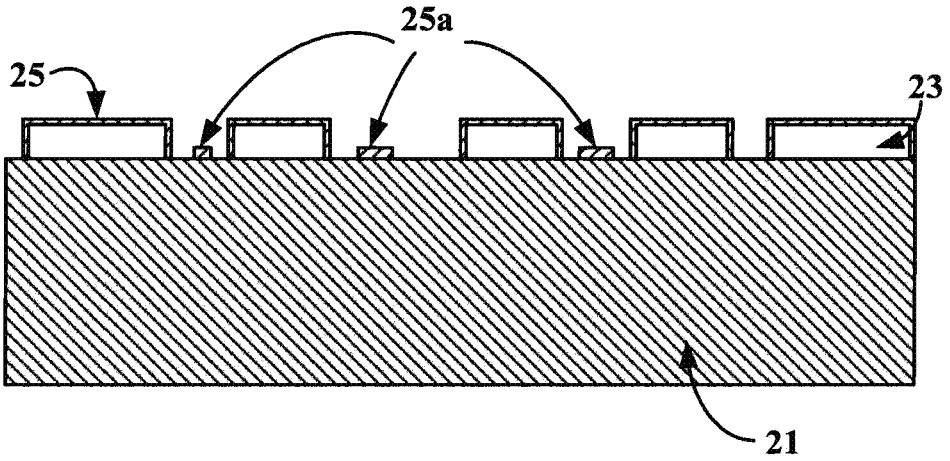
FIG. 4 is a schematic cross-sectional view of a structure including multiple corrosion-resistant particles having a conductive nitride layer and deposited on the surface of a corrosion-resistant metal substrate, according to an embodiment.

FIG. 4 is a schematic cross-sectional view of a structure having multiple corrosion-resistant particles 23 having a conductive nitride layer 25 deposited on the surface of a corrosion-resistant metal substrate 21, according to an embodiment. The conductive nitride layer 25 can be used as highly-electrically-conductive contact points for contacting metal components in, for example, an electrochemical device. The corrosion-resistant metal substrate 21 in FIG. 4 can be substantially similar, that is, can be made of substantially the same materials, as the corrosion-resistant metal substrates 10 or 20 described above with respect to FIGS. 1A-3. The corrosion-resistant particles 23 can be an initial material that can be used as a precursor for the conductive nitride layer 25.

The corrosion-resistant particles 23 can be deposited and/or bonded on the top surface of the corrosion-resistant metal substrate 21. The corrosion-resistant particles 23 can be disposed on the top surface of the corrosion-resistant metal substrate 21 through a thermal spraying process, a selective plating process, a selective etching process, or a sputtering process using shield masks, for example. The corrosion-resistant particles 23 can be deposited as splats, dots, and/or strips, in accordance with the deposition technique used. The corrosion-resistant particles 23 can include titanium, chromium, or nickel, or an alloy made of any one of those materials, for example. A thickness associated with the corrosion-resistant particles 23 is in the range of about 0.1 μm to about 100 μm. In some embodiments, the thickness of the corrosion-resistant particles 23 can have a range of 0.1 μm-0.5 μm, 0.1 μm-1 μm, 0.1 μm-50 μm, 0.5 μm-1 μm, 1 μm-2 μm, 1 μm-5 μm, 1 μm-10 μm, 1 μm-50 μm, 5 μm-50 μm, 10 μm-50 μm, 20 μm-50 μm, or 50 μm-100 μm, for example, with a range of 0.1 μm-50 μm being desirable in certain embodiments.

The conductive nitride layer 25 can be formed by using a nitration process that includes annealing the corrosion-resistant particles 23 at a temperature range of about 800° C. to about 1300° C. in a substantially pure nitrogen atmosphere. In some instances, the nitration process may also result in a nitride layer 25*a* being formed in portions of the top surface of the corrosion-resistant metal substrate 21 that are void of a corrosion-resistant particles 23. The nitride layer 25*a*, however, need not adversely affect the electrical conductance or the corrosion resistance of the corrosion-resistant metal substrate 21. A thickness associated with the conductive nitride layer 25 is in the range of about 1 nm to about 10 μm. In some embodiments, the thickness of the conductive metal layer 24 can have a range of 1 nm-5 nm, 1 nm-10 nm, 2 nm-1 μm, 10 nm-50 nm, 10 nm-100 nm, 1 nm-0.5 μm, 5 nm-20 nm, 20 nm-0.5 μm, 100 nm-0.5 μm, 100 nm-1 μm, or 1 μm-10 μm for example, with a range of 2 nm-1 μm being desirable in certain embodiments.

The corrosion-resistant particles 23 can be deposited to cover a portion of the surface of the corrosion-resistant metal substrate 21 that is less than the entire surface of the corrosion-resistant metal substrate 21. In this manner, the corrosion-resistant particles 23 with the conductive nitride layer 25 can increase the electrical conductance of the surface of the corrosion-resistant metal substrate 21 but at a lower cost than if a continuous metal layer was deposited on the corrosion-resistant metal substrate 21. Similar ratios or percentages as described above in FIG. 1A with respect to the portion of the top surface area of the corrosion-resistant metal substrate 10 covered by the metal splats 12 are also applicable to the coverage provided by the corrosion-resistant particles 23 in FIG. 4.

Figure 5A:
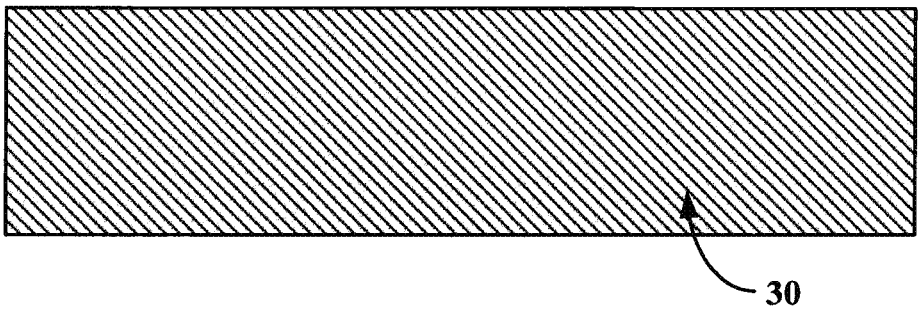
FIGS. 5A-5C are schematic cross-sectional views of a structure having multiple electrically-conductive ceramic particles and a corrosion-resistant bonding metal to bond the ceramic particles on the surface of a corrosion-resistant metal substrate, according to an embodiment.
Figure 5B:
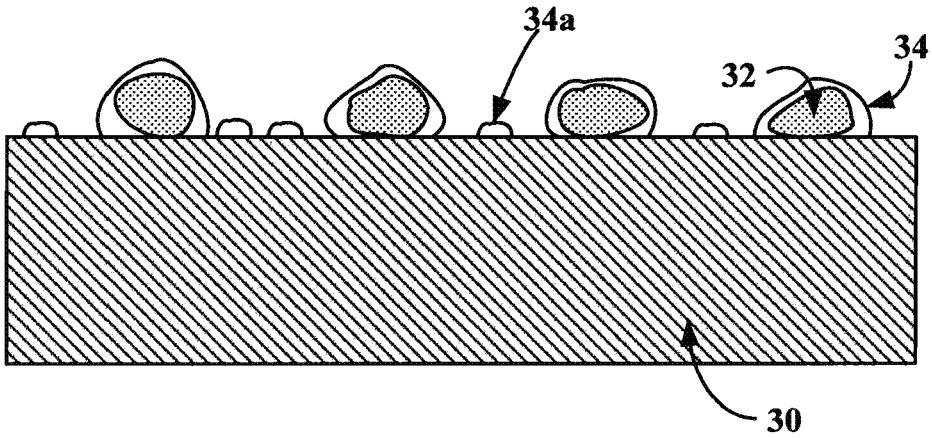
Figure 5C:
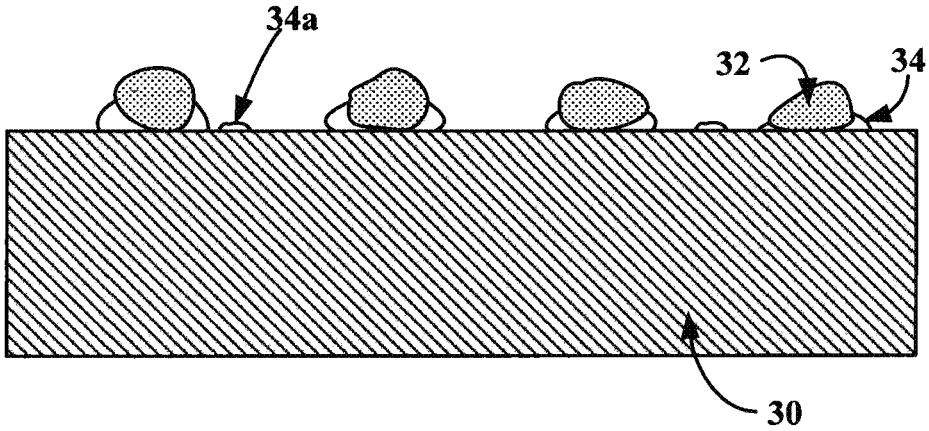

FIGS. 5A-5C are schematic cross-sectional views of a structure having multiple electrically-conductive ceramic particles 32 and a corrosion-resistant bonding metal 34 to bond the electrically-conductive ceramic particles 32 on the surface of a corrosion-resistant metal substrate 30, according to an embodiment. The corrosion-resistant metal substrate 30 in FIGS. 5A-5C can be substantially similar, that is, can be made of substantially the same materials, as the corrosion-resistant metal substrates 10 or 20 described above with respect to FIGS. 1A-3.

In FIG. 5A, the corrosion-resistant metal substrate 30 is shown before the electrically-conductive ceramic particles 32 having the corrosion-resistant bonding metal 34 are deposited. In FIG. 5B, the electrically-conductive ceramic particles 32 that are deposited on the top surface of the corrosion-resistant metal substrate 30 can include metal carbides, metal borides, or metal nitrides, for example. Each electrically-conductive ceramic particle 32 can have a corrosion-resistant bonding metal or alloy 34 disposed on at least a portion of its outer surface. In some embodiments, the electrically-conductive ceramic particles 32 and the corrosion-resistant bonding metal 34 can be mixed or formed into a composite. The corrosion-resistant bonding metal 34 can include titanium, niobium, zirconium, gold, palladium, platinum, iridium, ruthenium, or a corrosion-resistant alloy such as hastelloy C-276, stainless steel, or alloys based on iron, chromium, nickel, titanium, or zirconium, for example. The electrically-conductive ceramic particles 32 are used as the highly-electrical conductive contact points to reduce the electrical contact resistance of the corrosion-resistant metal substrate 30, and the bonding metal 34 is used to bond the electrically-conductive ceramic particles 32 to the substrate 30.

As shown in FIG. 5B, the electrically-conductive ceramic particles 32 with the corrosion-resistant boding metal 34 can be thermal sprayed and/or bonded onto the surface of the corrosion-resistant metal substrate 30. When thermally sprayed, the corrosion-resistant boding metal 34 is melted as part of the thermal spraying process and can result in small blobs or pieces of the corrosion-resistant boding metal 34 (e.g., metal 34*a*) being deposited on the top surface of the corrosion-resistant metal substrate 30. The metal 34*a*, however, need not adversely affect the electrical conductance or the corrosion resistance of the corrosion-resistant metal substrate 30. As a result of the spraying and/or bonding processes, the electrically-conductive ceramic particles 32 can be isolated, connected with at least one other electrically-conductive particle 32, and/or overlapping with at least one other electrically-conductive particle 32. After the thermal spray deposition, the electrically-conductive ceramic particles 32 can be partially or completely covered by the corrosion-resistant boding metal 34.

FIG. 5C shows at least a portion of the corrosion-resistant boding metal 34 being removed from the electrically-conductive ceramic particles 32. The removal can be done by a chemical etching process, an electro-chemical polishing process, or a mechanical polishing process. In one example, during a chemical etching process, the amount of corrosion-resistant boding metal 34 that is removed can be based on the etching rate and the duration of the process. By removing a portion of the corrosion-resistant boding metal 34, the electrically-conductive ceramic particles 32 are exposed and can be used as highly-electrically-conductive contact points to reduce the electrical contact resistance of corrosion-resistant metal substrate 30. The corrosion-resistant boding metal 34 can be used to connect the electrically-conductive ceramic particles 32 to the corrosion-resistant metal substrate 30. In some embodiments, the corrosion-resistant metal substrate 30 and the corrosion-resistant bonding metal 34 can go through a passivation process to further improve its corrosion resistance characteristics. An example of a passivation process includes a thermal oxidation process to grow a dense oxide layer. In another example, an anodizing or similar process can be used as a passivation process.

The electrically-conductive ceramic particles 32 can be deposited to cover a portion of the top surface of the corrosion-resistant metal substrate 30 that is less than the entire surface of the corrosion-resistant metal substrate 30. Similar ratios or percentages as described above in FIG. 1A with respect to the portion of the top surface area of the corrosion-resistant metal substrate 10 covered by the metal splats 12 are also applicable to the coverage provided by the electrically-conductive ceramic particles 32 in FIGS. 5A-5C.

Figure 6A:
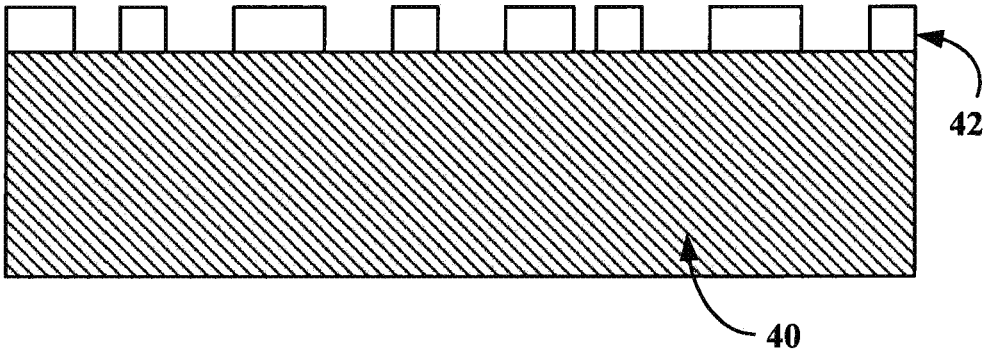
FIGS. 6A-6C are schematic cross-sectional views of a structure including alloy particles having electrically-conductive inclusions as the highly-electrically conductive contact points that are deposited on the surface of a corrosion-resistant metal substrate, according to an embodiment.
Figure 6B:
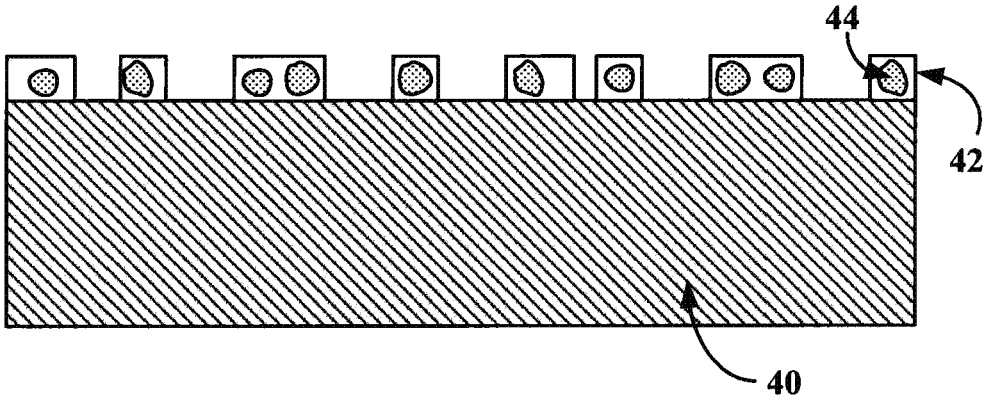
Figure 6C:
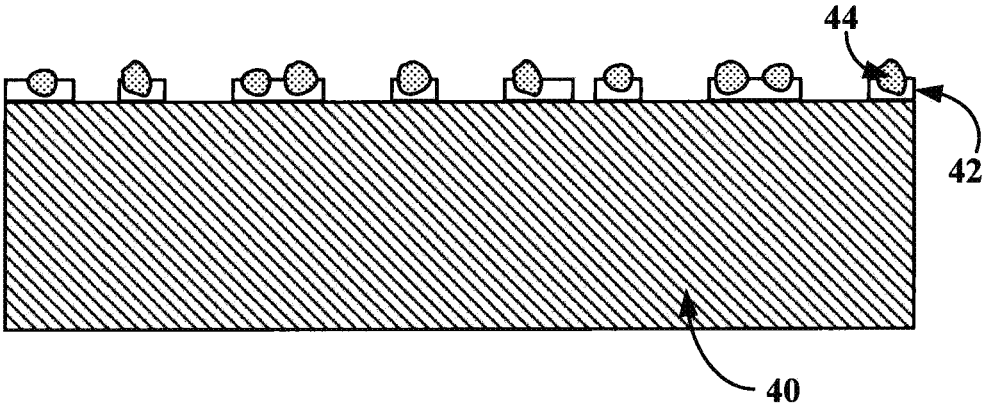

FIGS. 6A-6C are schematic cross-sectional views of a structure including alloy particles 42 having electrically-conductive inclusions 44 that are deposited on the surface of a corrosion-resistant metal substrate 40, according to an embodiment. The electrically-conductive inclusions 44 are precipitates in the alloy 42 that occur after an appropriate thermal treatment. The electrically-conductive inclusions 44 can be used as highly-electrically-conductive contact points for contacting metal components in, for example, an electrochemical device. The corrosion-resistant metal substrate 40 in FIGS. 6A-6C can be substantially similar, that is, can be made of substantially the same materials, as the corrosion-resistant metal substrates 10 or 20 described above with respect to FIGS. 1A-3. The alloy particles 42 can be an initial material that can be used as a precursor for the electrically-conductive inclusions 44.

In FIG. 6A, the alloy particles 42 can be made of stainless steel, chromium, molybdenum, tungsten, or niobium, or of an alloy containing chromium, molybdenum, tungsten, or niobium and having a carbon content of less than 9%, a boron content of less than 5%, or a nitrogen content of less than 1%. In one embodiment, the alloy particles 42 can be sprayed (e.g., thermally sprayed) and/or bonded to the surface of the corrosion-resistant metal substrate 40. In another embodiment, the alloy particles 42 can be deposited on the surface of the corrosion-resistant metal substrate 40 by a sputtering process or a plating process. U.S. Pat. No. 6,379,476 describes a method to use electrically conductive inclusions having high concentrations of carbon, nitrogen, and/or boron in a specially-formulated stainless steel substrate to improve the surface electrical conductance of the stainless steel and is hereby incorporated herein by reference in its entirety. As a result of the spraying and/or bonding processes, the alloy particles 42 can be isolated, connected, or overlapping and can cover a portion of the surface of the corrosion-resistant metal substrate 40.

In FIG. 6B, the alloy particles 42 are heat or thermally treated under controlled conditions to cause the carbon, nitrogen, and/or boron in the splats 42 to precipitate in form of metal carbide, metal nitride, and/or metal boride inclusions 44. FIG. 6C shows the inclusions 44 being exposed by removing a top portion of the splats 42 through a chemical etching process, an electro-chemical polishing process, or a mechanical polishing process to expose the inclusions on the surface. These exposed inclusions can be used as the highly-electrically-conductive contact points to provide the surface of the corrosion-resistant metal substrate 40 with a low electrical contact resistance. The portion of the alloy particles 42 that remain after exposing the electrically-conductive inclusions 44 can be used to connect the electrically-conductive inclusions 44 to the corrosion-resistant metal substrate 40. In some embodiments, the corrosion-resistant metal substrate 40 can go through a passivation process to further improve its corrosion resistance.

As described above, the alloy 42 can be deposited to cover a portion of the top surface of the corrosion-resistant metal substrate 40 that is less than the entire surface of the corrosion-resistant metal substrate 40, or the whole surface of the corrosion-resistant metal substrate 40. Moreover, when less than the entire surface of the corrosion resistant metal substrate 40 is covered, similar ratios or percentages as described above in FIG. 1A with respect to the portion of the top surface area of the corrosion-resistant metal substrate 10 covered by the metal splats 12 are also applicable to the coverage provided the splats 42 in FIGS. 6A-6C.

Figure 7:
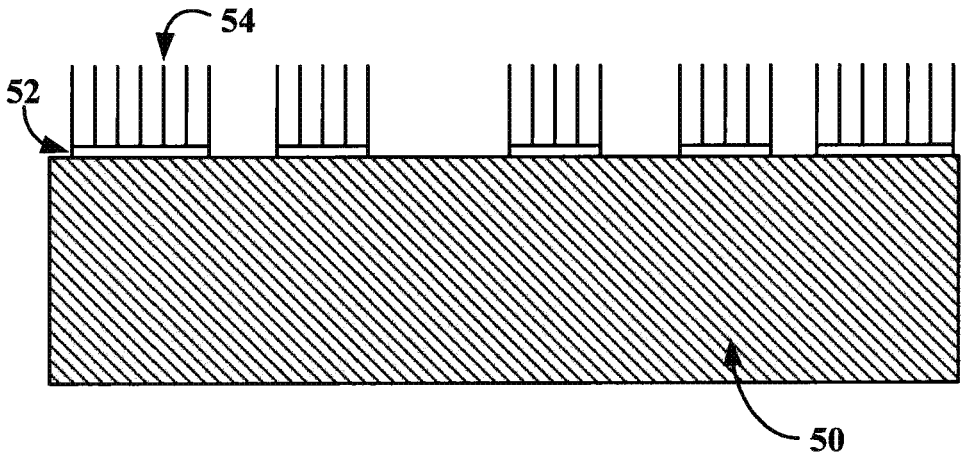
FIG. 7 is a schematic cross-sectional view of a structure including multiple carbon nanotubes grown on a catalyst deposited on the surface of a corrosion-resistant metal substrate, according to an embodiment.

FIG. 7 is a schematic cross-sectional view of a structure including multiple carbon nanotubes 54 grown on a catalyst 52 deposited on the surface of a corrosion-resistant metal substrate 50, according to an embodiment. The corrosion-resistant metal substrate 50 in FIG. 7 can be substantially similar, that is, can be made of substantially the same materials, as the corrosion-resistant metal substrates 10 or 20 described above with respect to FIGS. 1A-3. The catalyst 52 can be an initial material that can be used as a precursor for the carbon nanotubes 54.

The carbon nanotubes 54 can be used as highly-electrically-conductive contact points to reduce the electrical contact resistance of the corrosion-resistant metal substrate 50. The thin layer of catalyst 52 is used to enable the growth of the carbon nanotubes 54 on the corrosion-resistant metal substrate 50. In some embodiments, the carbon nanotubes 54 can be grown on substantially the entire top surface of the corrosion-resistant metal substrate 50. In other embodiment, the carbon nanotubes 54 can be grown on a portion or on multiple portions of top surface of the corrosion-resistant metal substrate 50. In some embodiments, such as when the corrosion-resistant metal substrate 50 is a nickel-containing alloy structure, for example, it may be possible to grow the carbon nanotubes 54 directly from the corrosion-resistant metal substrate 50 without the need of the catalyst 52.

When growing the carbon nanotubes 54, a very thin layer of the catalyst 52 is deposited on the metal surface. The catalyst 52 can include nickel, iron, platinum, palladium, and/or other materials with like properties. The catalyst 52 can be deposited such that it covers substantially the entire top surface of the corrosion-resistant metal substrate 50 or can be deposited to cover a portion or multiple portions of the surface of the corrosion-resistant metal substrate 50. The corrosion-resistant metal substrate 50 with the catalyst 52 is placed in the reaction chamber to grow the carbon nanotubes 54 on the catalyst 52 through a chemical vapor deposition (CVD) process or through a plasma enhanced chemical vapor deposition (PECVD) process. When desirable, the catalyst 52 that may exist on top of the carbon nanotubes 54 can be removed through a chemical etching process or through an electro-chemical etching process after the carbon nanotubes 54 are firmly attached to the top surface of the corrosion-resistant metal substrate 50. In some embodiments, the corrosion-resistant metal substrate 50 can go through a passivation process to enhance its corrosion resistance.

Figure 8:
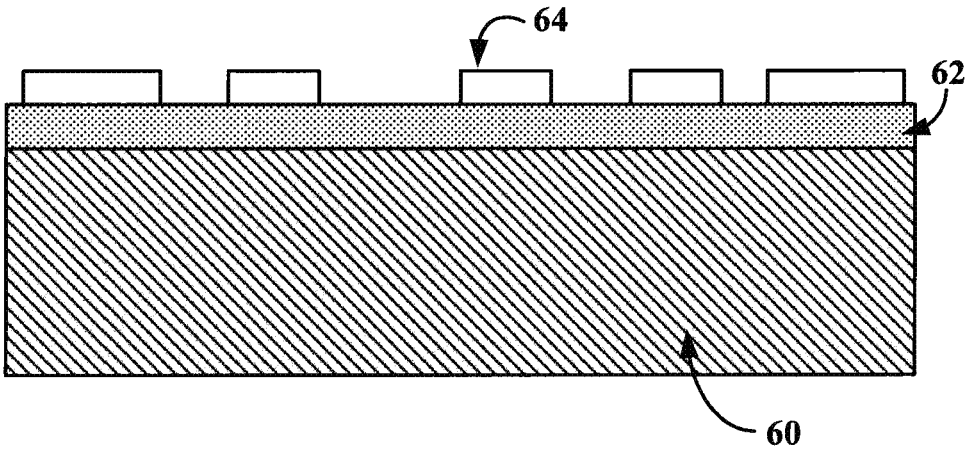
FIG. 8 is a schematic cross-sectional view of a structure including multiple electrically-conductive splats on a corrosion-resistant coating layer deposited on the surface of a corrosion-resistant metal substrate and having better corrosion resistance properties than the corrosion-resistant metal substrate, according to an embodiment.

FIG. 8 is a schematic cross-sectional view of a structure including multiple highly-electrically-conductive contact points 64 on a corrosion-resistant coating layer 62 deposited on the surface of a corrosion-resistant metal substrate 60, according to an embodiment. The corrosion-resistant coating layer 62 can have better corrosion resistance properties than the corrosion-resistant metal substrate 60. A better corrosion resistance and low electrical contact resistance of the corrosion-resistant metal substrate 60 can be achieved by depositing the corrosion-resistant coating layer 62 on the surface of the corrosion-resistant metal substrate 60 and subsequently depositing a thin layer of an electrically-conductive material (such as the highly-electrically-conductive contact point 64) on a portion of the surface of the corrosion-resistant coating layer 62.

The corrosion-resistant metal substrate 60 can include low-cost carbon steel, stainless steel, copper, and/or aluminum, and/or alloys made of any one of these materials. In one example, the corrosion-resistant coating layer 62 can include titanium, zirconium, niobium, nickel, chromium, tin, tantalum, and/or silicon, and/or alloys made of any one of these materials. In another example, the corrosion-resistant layer 62 can include electrically-conductive or semi-conductive compounds, such as silicon carbide or chromium carbide, titanium nitride for example. A thickness of the corrosion-resistant layer 62 can range from about 1 nm to about 50 μm. In some embodiments, the thickness of the corrosion-resistant layer 62 can have a range of 1 nm-100 nm, 1 nm-200 nm, 1 nm-10 μm, 0.01 μm-0.5 μm, 0.01 μm-1 μm, 1 μm-5 μm, 1 μm-10 μm, 10 μm-20 μm, 10 μm-50 μm, or 20 μm-50 μm, for example, with a range of 1 nm-10 μm being desirable in certain embodiments.

The corrosion-resistant coating layer 62 can be disposed on the top surface of the corrosion-resistant metal substrate 60 by using a vapor deposition process (e.g., PVD or CVD) or a plating process. By applying a relatively thick coating for the corrosion-resistant coating layer 62, it may be possible to minimize the number and/or the size of defects that typically occur when coating a substrate. Moreover, to improve the adhesion of the corrosion-resistant coating layer 62 to the corrosion-resistant metal substrate 60, the corrosion-resistant metal substrate 60 with the corrosion-resistant coating layer 62 can go through a proper heat treatment (e.g., bonding process). For example, the corrosion-resistant metal substrate 60 with the corrosion-resistant layer 62 can be thermally treated at 450° C. in air for approximately one hour. Such thermal treatment can also be used to eliminate or minimize the number and/or size of tiny pores that typically occur as a result of a coating layer being deposited by PVD process. In some embodiments, to enhance the corrosion resistance properties of the corrosion-resistant coating layer 62, a surface passivation treatment can be applied on the corrosion-resistant coating layer 62 before or after the electrically-conductive splats 64 are deposited.

The highly-electrically-conductive contact points 64 can include gold, palladium, platinum, iridium, ruthenium, niobium, and/or osmium, as described above with respect to FIGS. 1A-2B, for example. The highly-electrically-conductive contact points 64 can also include nitrides, carbides borides, or carbon nanotubes, as described above with respect to FIGS. 3-7, for example.

The highly-electrically-conductive contact points 64 can be deposited using any one of an electro-plating process, electroless plating process, a thermal spraying process, vapor deposition process, or a metal brushing process, for example. A high-temperature treatment can be used after deposition to enhance the bonding between the highly-electrically-conductive contact points 64 and the corrosion-resistant coating layer 62.

In some embodiments, an additional layer (not shown in FIG. 8), such as an interface layer used as a diffusion barrier layer or a bonding layer, for example, can be deposited or placed between the corrosion-resistant metal substrate 60 and the corrosion-resistant coating layer 62, and/or between the corrosion-resistant coating layer 62 and the highly-electrically-conductive contact points 64. A diffusion barrier layer can be used to minimize the diffusion of material from a lower surface or layer to an upper surface or layer during a heat treatment. A bonding layer can be used to improve the bonding or adhesion between layers to provide improved corrosion resistance characteristics for the corrosion-resistant metal substrate 60. In one example, the interface layer can include tantalum, hafnium, niobium, zirconium, palladium, vanadium, tungsten. The interface layer can also include some oxides and/or nitrides. A thickness associated with the interface layer can be in the range of 1 nm-10 μm. In some embodiment, the thickness of the interface layer can have a range of 1 nm-5 nm, 1 nm-10 nm, 1 nm-1 μm, 0.01 μm-1 μm, 1 μm-2 μm, 1 μm-5 μm, 1 μm-10 μm, or 5 μm-10 μm, for example, with a range of 0.01 μm-1 μm being desirable in certain embodiments.

In a first example of a method to produce a structure such as the one described above with respect to FIG. 8, a 1 μm titanium coating layer (corrosion-resistant coating layer 62) can be deposited on a stainless steel 316 (SS316) substrate (corrosion-resistant metal substrate 60) using a sputtering process. Subsequently, a layer of gold splats (highly-electrically-conductive contact points 64) is deposited (e.g., thermally sprayed) on the titanium coating layer surface as dots or splats that cover a portion of the surface area of the titanium layer. After the gold dots or splats are deposited, the titanium-coated SS316 can be thermally treated at 450° C. in air to enhance the bonding of the gold splats to the titanium coating layer surface and of the titanium coating layer to the SS316 substrate.

Figure 9:
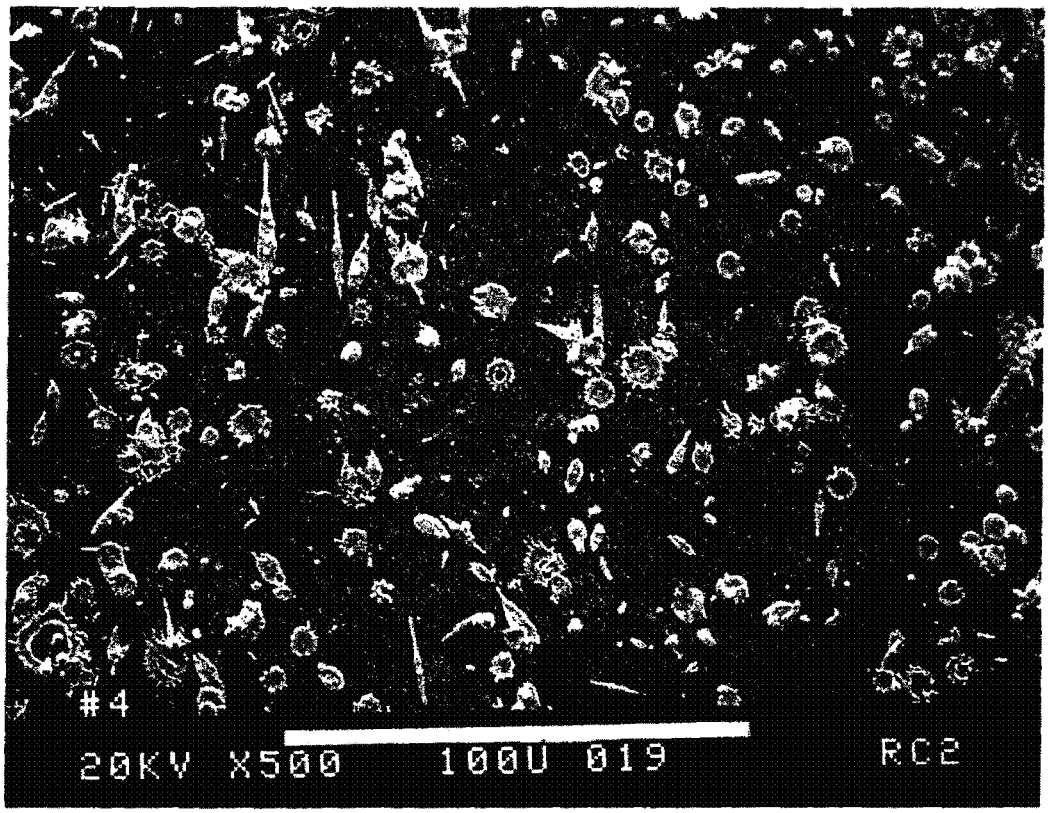
FIG. 9 is an SEM picture of thermally sprayed gold on a titanium surface, according to an embodiment.
Figure 10:
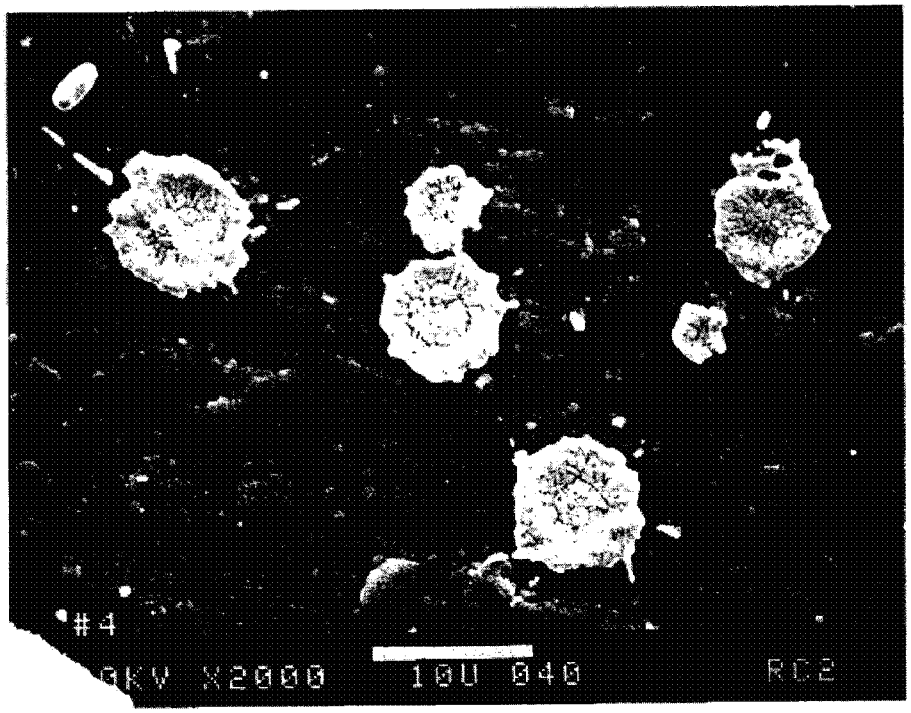
FIGS. 10-11 are an SEM picture and an optical microscopic picture, respectively, of thermally sprayed gold on a titanium-coated stainless steel surface, according to an embodiment.
Figure 11:
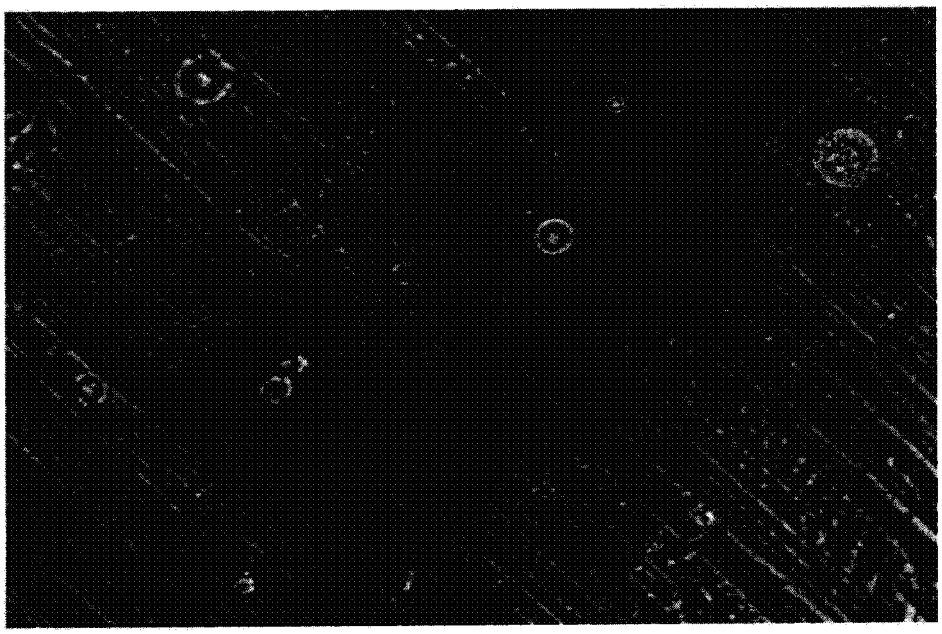

FIG. 9 is a scanning electron microscope (SEM) picture of thermally sprayed gold on a 0.004" thick titanium foil surface, according to an embodiment. FIGS. 10-11 are an SEM picture and an optical microscopic picture, respectively, of thermally sprayed gold on a titanium-coated 0.004" thick stainless steel foil surface, according to an embodiment. Each of the FIGS. 9-11 illustrates a plan or top view of structures that have been made in a substantially similar manner to the manner in which the structure in the above-described example is made.

Figure 12:
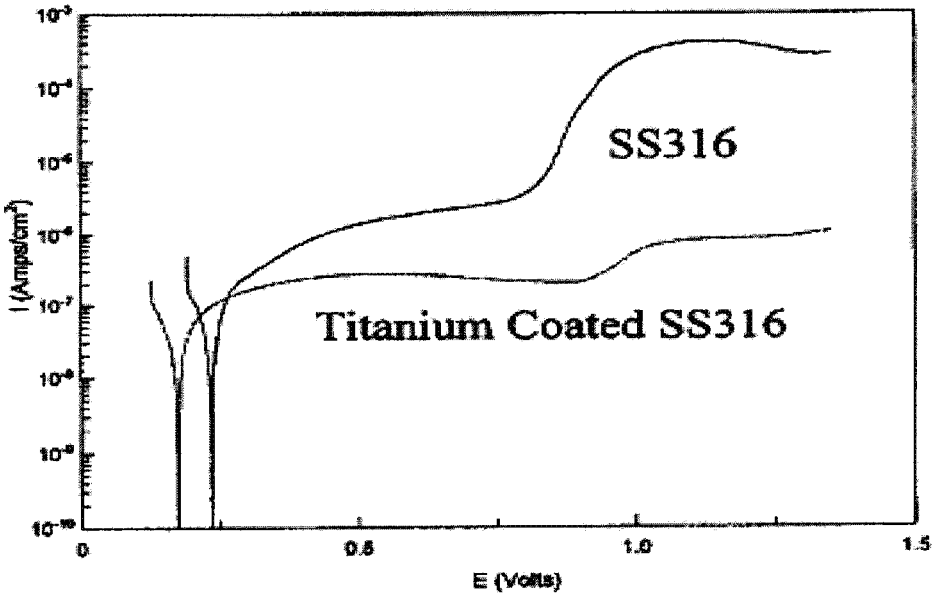
FIG. 12 is a plot illustrating dynamic polarization electrochemical corrosion data of standard SS316 (stainless steel) surface, according to an embodiment.

FIG. 12 is a plot illustrating dynamic polarization electrochemical corrosion data of standard SS316 substrate surface, according to an embodiment. The test can be conducted using a pH 2 $H_2SO_4$ solution with 50 parts-per-million (ppm) fluoride at 80° C. with a potential scanning rate of 10 millivolts-per-minute (mV/min). The plot in FIG. 12 illustrates that the titanium-coated SS316 substrate can have a much lower corrosion current than the corrosion current of a standard SS316 substrate, that is, an SS316 substrate without the corrosion-resistant coating layer 62. The test substrate in FIG. 12 can be based on a second example of a method to produce a structure such as the one described above with respect to FIG. 8. In this example, a thick (~3 μm) titanium coating layer (corrosion-resistant coating layer 62) is deposited on an SS316 substrate (corrosion-resistant metal substrate 60) using an electron beam (e-beam) evaporation process. Then gold splats are thermally sprayed on the titanium-coated SS316 substrate. In addition, the titanium-coated SS316 substrate is heat treated at 450° C. in air to have better adhesion.

Figure 13:
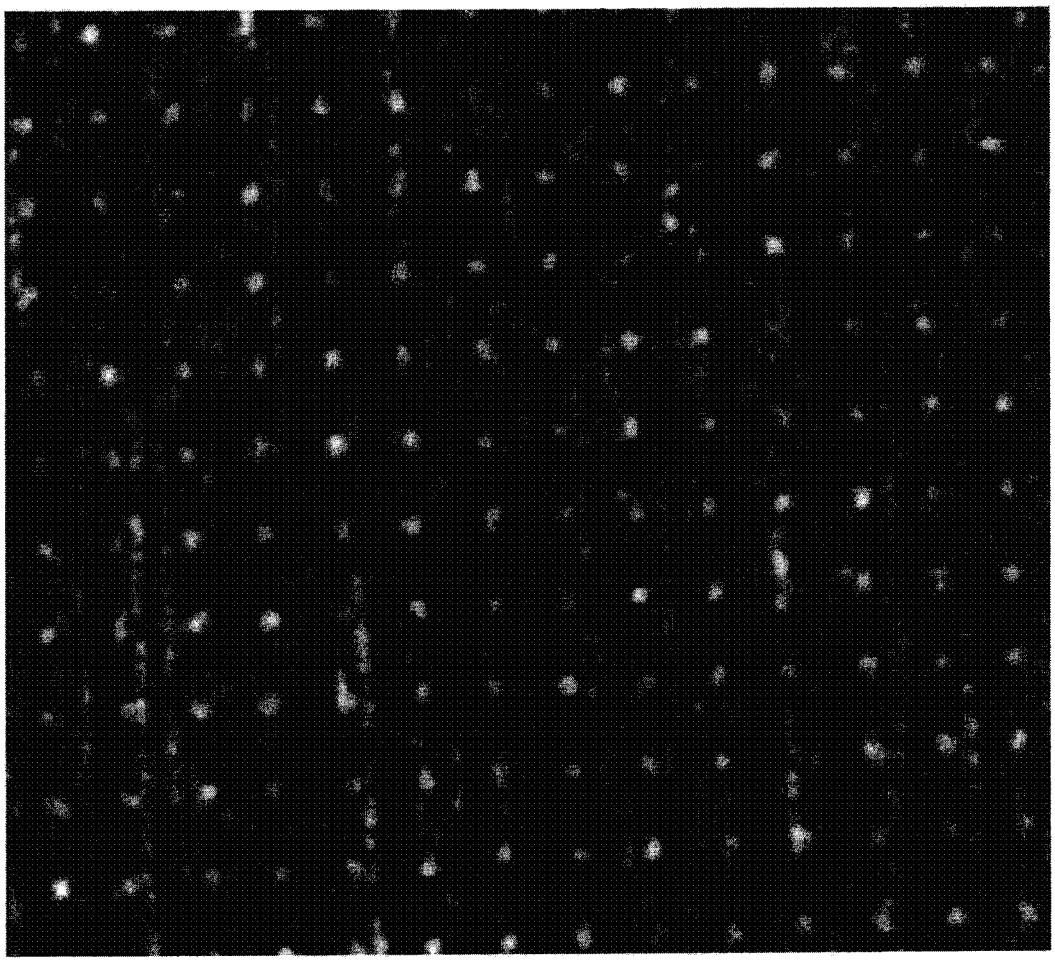
FIG. 13 is an optical microscopic picture of multiple gold dots patterned on the surface of a corrosion-resistant metal substrate, according to an embodiment.

In some embodiments, photolithographic techniques can be used to produce a particular pattern or arrangement for the metal dots or splats that are deposited a substrate such as the titanium-coated SS316 substrates in FIGS. 9-11 or the corrosion-resistant metal substrate 10 in FIGS. 1A-2B, for example. Such patterns can be achieved by using regularly-spaced openings in masks and depositing the electrically-conductive material by using, for example, a sputtering process. FIG. 13 is an optical microscopic picture that shows multiple gold dots patterned on a top surface of a corrosion-resistant metal substrate, according to an embodiment.

When depositing materials, layers, or coatings onto an substrate, coating defects generally occur as a result of such processes. These defects could be in the form of small pinholes, or as micro-cracks in the coating layer (e.g., the corrosion-resistant coating layer 62). Such defects can cause the accelerated corrosion of the corrosion-resistant metal substrate 60 because of the electrical coupling that can take place between the substrate metal 60 and the coating layer material 62. Below are described various embodiments in which a plating process can be used to seal the defects that can occur in the corrosion-resistant coating layer 62 by selectively plating (e.g., electro-plating, electroless plating) corrosion-resistant metals, such as gold, palladium, chromium, tin, or platinum, for example, into the defects to cover the exposed portions of the corrosion-resistant metal substrate 60. For example, the selective electro-plating of the precious metals can occur by controlling a voltage such that the corrosion-resistant metal primarily attaches to the defect in the corrosion-resistant coating layer 62, instead of on the surface of the corrosion-resistant coating layer 62. An appropriate voltage or voltages to use in selective electro-plating applications can be typically determined empirically. A heat treatment process or step can used to ensure an effective bonding and/or sealing of the plated gold, palladium, tin, chromium, or platinum with the corrosion-resistant metal substrate 60 and/or the corrosion-resistant coating layer 62. In this regard, the plated metal not only seals the coating defects but is also used as an electrical conductive via or conductive conduit between the corrosion-resistant metal substrate 60 and the corrosion-resistant coating layer 62 that can enhance the electrical conductance characteristics of the corrosion-resistant metal substrate 60. In some embodiments, the sealing of coating defects can be done before the highly-electrically-conductive contact points 64 are disposed on the corrosion-resistant layer 62.

Figure 14:
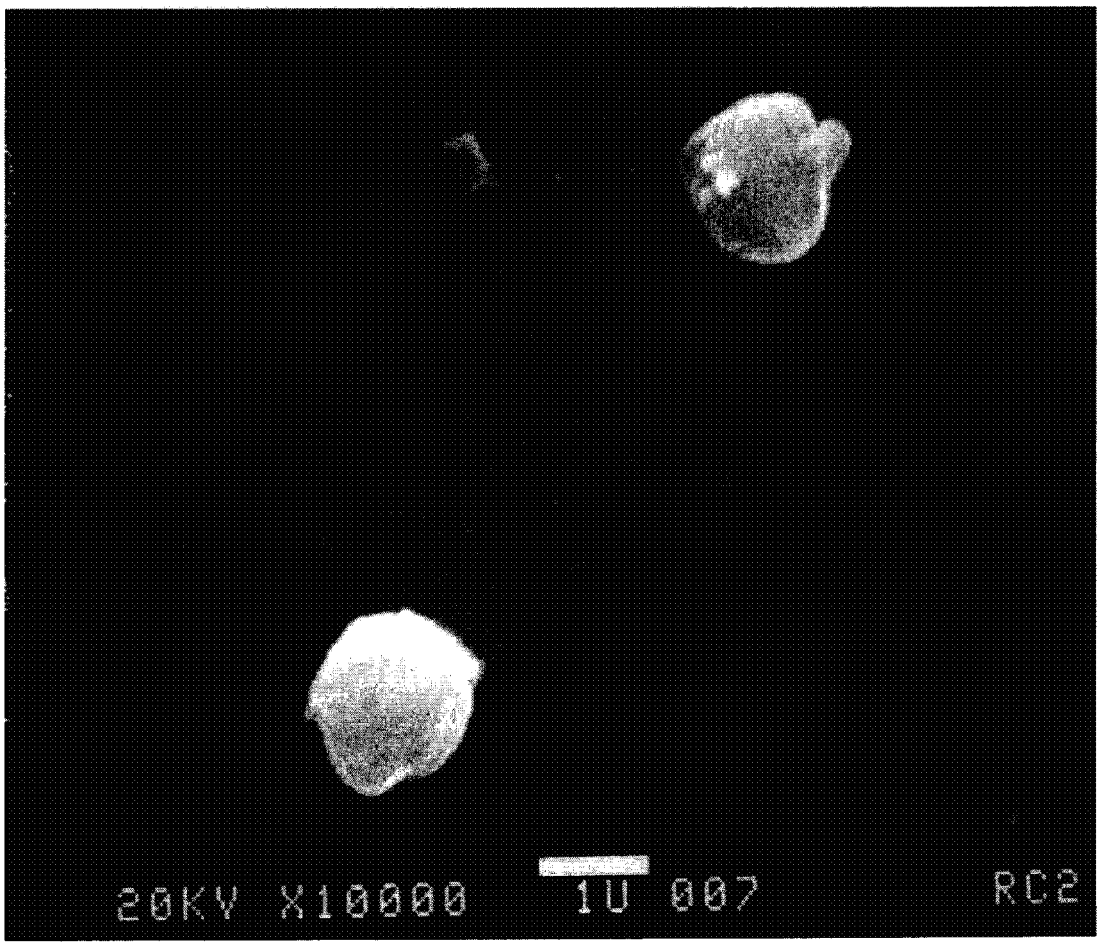
FIG. 14 is a scanning electron microscope (SEM) picture of a silicon-coated stainless steel surface with gold-sealed pinholes in the silicon coating layer, according to an embodiment.

FIG. 14 is a scanning electron microscope (SEM) picture of a silicon-coated stainless steel surface with gold-sealed pinholes in the silicon coating layer, according to an embodiment. A stainless steel substrate can have a silicon-based corrosion-resistant coating layer. As shown in FIG. 14, these defects could be sealed by a selective plating process such that the effect of these defects on the corrosion resistance of the metal substrate is minimized or reduced. Electrochemical corrosion tests performed on such treated structures indicate that the corrosion rate of the stainless steel with open defects in the corrosion-resistant coating layer 62 is higher than that of stainless steel with sealed defects on the corrosion-resistant coating layer 62.

The various embodiments described above have been presented by way of example, and not limitation. It will be apparent to persons skilled in the art(s) that various changes in form and detail can be made therein without departing from the spirit and scope of the disclosure. In fact, after reading the above description, it will be apparent to one skilled in the relevant art(s) how to implement alternative embodiments. Thus, the disclosure should not be limited by any of the above-described exemplary embodiments.

Moreover, the methods and structures described above, like related methods and structures used in the electrochemical arts are complex in nature, are often best practiced by empirically determining the appropriate values of the operating parameters, or by conducting computer simulation to arrive at the best design for a given application. Accordingly, all suitable modifications, combinations, and equivalents should be considered as falling within the spirit and scope of the disclosure.

In addition, it should be understood that the figures are presented for example purposes only. The structures provided in the disclosure are sufficiently flexible and configurable, such that they may be formed and/or utilized in ways other than those shown in the accompanying figures.

What is claimed is:

1. An apparatus having high corrosion resistance and low electrical contact resistance for electrochemical applications, said apparatus comprising:

a corrosion-resistant metal substrate; and a plurality of highly-electrically-conductive contact points deposited by flame or plasma spray that melts or partially melts and deposits highly electrical conductive material particles on a surface of the corrosion-resistant metal substrate and covering a portion of the surface of the corrosion-resistant metal substrate that is less than an entire surface of the corrosion-resistant metal substrate;

the highly-electrically-conductive contact points are in the form of splats, wherein a thickness associated with the plurality of contact points is in the range of 10 nanometers to 2 microns, and the plurality of contact points cover 0.5% to 95% of the surface area of the corrosion-resistant metal substrate, and wherein the highly-electrically-conductive contact points have an electrical contact resistance of about 50 milliohms-per-square centimeter ($m\Omega.cm^2$) or lower.

2. The apparatus of claim 1, wherein the corrosion-resistant metal substrate includes a material from the group consisting of titanium, niobium, zirconium, tantalum, carbon steel, stainless steel, copper, aluminum, or their alloys.

3. The apparatus of claim 1, wherein the corrosion-resistant metal substrate is made of a low cost metal substrate with a corrosion-resistant coating layer, and the corrosion-resistant coating layer includes titanium, zirconium, niobium, nickel, chromium, tin, tantalum, and/or silicon, and/or their alloys.

4. An apparatus, comprising:

a metal substrate;

a corrosion-resistant coating layer disposed on a surface of the metal substrate; and an electrically-conductive and corrosion-resistant material disposed by flame or plasma spray that melts or partially melts and deposits highly electrical conductive material particles on a portion of a surface of the corrosion-resistant coating layer less than an entire surface of the corrosion-resistant coating layer, the electrically-conductive and corrosion-resistant material is disposed as isolated dots in the form of splats, wherein a thickness associated with the plurality of dots is in the range of 10 nanometers to 2 microns, and the plurality of isolated dots cover 0.5% to 95% of the surface area of the corrosion-resistant metal substrate, and wherein the electrically-conductive and corrosion-resistant material has an electrical contact resistance of about 50 milliohms-per-square centimeter ($m\Omega.cm^2$) or lower.

5. The apparatus of claim 4, wherein the metal substrate is made of carbon steel, stainless steel, copper, aluminum, or their alloys.

6. The apparatus of claim 4, wherein the corrosion-resistant coating layer includes titanium, zirconium, niobium, nickel, chromium, tin, tantalum, silicon, a metal nitride, a metal carbide, or their alloys, and wherein the corrosion-resistant coating layer has a thickness in the range of about 0.001 micron to about 10 microns.

7. The apparatus of claim 4, wherein the electrically-conductive and corrosion-resistant material includes a material selected from the group consisting of gold, palladium, platinum, iridium, ruthenium, metal carbides, metal borides, metal nitrides, and carbon nanotubes.

8. The apparatus of claim 4, further comprising:

an interface layer disposed on at least one of the interface between the metal substrate and the corrosion-resistant coating layer and the interface between the corrosion-resistant layer and the electrically-conductive and corrosion-resistant material.

9. The apparatus of claim 8, wherein the interface layer includes a material from the group consisting of tantalum, hafnium, niobium, zirconium, palladium, vanadium, tungsten, oxides, and nitrides, the interface layer having a thickness in the range of about 1 nanometer to about 10 microns.

* * * * *